United States Patent [19]

Porter

[11] Patent Number: 4,738,191

[45] Date of Patent: Apr. 19, 1988

[54] ALUMINUM AIR VENT LOUVER

[76] Inventor: Bryant E. Porter, 553 W. 9460 South, Sandy, Utah 84070

[21] Appl. No.: 902,188

[22] Filed: Aug. 29, 1986

[51] Int. Cl.[4] ..... F24F 13/08

[52] U.S. Cl. ..... 98/121.1; 98/114

[58] Field of Search ..... 98/29, 121.1, 114

[56] References Cited

U.S. PATENT DOCUMENTS

| | | | |
|---|---|---|---|
| 2,340,570 | 2/1944 | Siebenlist | 98/121.1 |
| 3,060,834 | 10/1962 | Cira | 98/121.1 |
| 3,345,930 | 10/1967 | Ammons | 98/114 |
| 3,422,744 | 1/1969 | Tarnoff | 98/121.1 |
| 4,050,366 | 9/1977 | Wiklund et al. | 98/121.1 X |
| 4,248,022 | 2/1981 | Walker | 98/114 X |
| 4,550,648 | 11/1985 | Eagle | 98/121.1 X |
| 4,592,271 | 6/1986 | Young | 98/114 |

FOREIGN PATENT DOCUMENTS

| | | | |
|---|---|---|---|
| 700262 | 12/1964 | Canada | 98/121.1 |

*Primary Examiner*—William E. Wayner
*Assistant Examiner*—Steven E. Warner
*Attorney, Agent, or Firm*—Thorpe, North & Western

[57] ABSTRACT

An air vent or louver for flush mounting to exterior walls of building comprises a wooden frame having a polygonal shape, a plurality of aluminum fins resembling wooden slats, and an aluminum facing resembling wood brick molding. The aluminum facing is formed around the wood frame and includes novel interlocking means for interengaging abutting corners of the aluminum members on the exterior face of the air vent or louver.

14 Claims, 2 Drawing Sheets

ALUMINUM AIR VENT LOUVER

BACKGROUND OF THE INVENTION

This invention relates to air vents or louvers used on exterior walls of buildings, and in particular to aluminum faced air vents or louvers which resemble wooden air vents and louvers.

It is customary and generally necessary to provide air vents for attic space beneath a roof of a residential building. In the past, wooden vents or louvers have been used. The wooden louvers were attractive as well as functional. The drawback with wooden louvers is in their constant need of maintenance. Aluminum siding has been used to reduce the maintenance required by wooden or other type structures. Aluminum vents or louvers have also been used. However, the aluminum vents unfortunately resemble a metal grating much more closely than they do wooden vents and louvers.

SUMMARY OF THE INVENIION

It is a principal object of the present invention to provide a flush mounted air vent or louver which is made of aluminum but closely resembles such an air vent made of wood.

A further object of the invention is to provide a sturdy, flush mounted air vent or louver comprising an aluminum facing resembling wood brick mold which is formed around a wood frame and which includes novel interlocking means for interengaging abutting corners of aluminum members on the exterior face of the air vent or louver.

Another object of the invention is to provide an air vent or louver of the type described in the previous paragraph which further comprises fin members formed from aluminum sheet stock, with each fin having a substantially flat front portion lying in the plane of the exterior face of the air vent or louver and with each fin further having a flat sloping portion which slopes from the exterior face of the air vent or louver to the back face thereof.

An additional object of the invention is to provide an air vent or louver of the type described in the previous paragraph whicn further comprises novel means for anchoring the front and back corners of the fin members to the respective faces of the air vent or louver.

A further object of the invention is to provide a novel method of making an aluminum faced air vent or louver of the general type disclosed herein.

The above and other objects of the invention are realized in specific illustrative embodiments which will be described in detail hereinafter. In general, the air vent or louver of this invention comprises a wood frame consisting of a plurality of wooden members attached end to end to form an enclosed, polygonal frame having broad, flat, open front and back faces.

A plurality of spaced aluminum fins extend from one side of the wood frame to the other, and means are provided for anchoring the front corners of the fins to the front face of the wood frame and for anchoring the back corners of the fins to the back face of the wood frame.

A circuitous aluminum face molding is formed around the wood frame. The face molding comprises an elongate sheet of aluminum which has been bent along its longitudinal length to form an elongate angle having first and second faces. Slits are cut in the first face of the angle, with the slits being spaced by the length of the polygonal sides at the perimeter of the wood frame. The angle is bent and formed around the wood frame so that the second face of the angle is formed as a continuous enclosure around the perimeter of the wood frame, with the sections between slits in the first face of the angle extending inwardly from the perimeter of the wood frame substantially in the plane of the exterior or front face of the wood frame. The adjacent sections of the first face are folded together at their longitudinal ends adjacent to the slits in the first face. Means are provided for interlocking the sections of the first face which are folded over each other to form a sturdy junction which resembles a mitered junction. The contiguous sections form a continuous boxed molding around the perimeter of the front face of the wood frame. The sections in the first face of the angle are preferably also provided with parallel bends spaced from the angle bend. The parallel bends in the first face resemble parallel, decorative, ridges in wooden brick molding, and the outer face of the aluminum air vent or louver has the appearance of being made of wooden brick molding.

Additional objects, features and advantages of the invention will become apparent from the following detailed description, taken together with the accompanying drawings.

THE DRAWINGS

Particular embodiments of the present invention representing the best mode presently contemplated of carrying out the invention are illustrated in the accompanying drawings in which.

DETAILED DESCRIPTION OF THE ILLUSTRATED EMBODIMENTS

Figure 1:
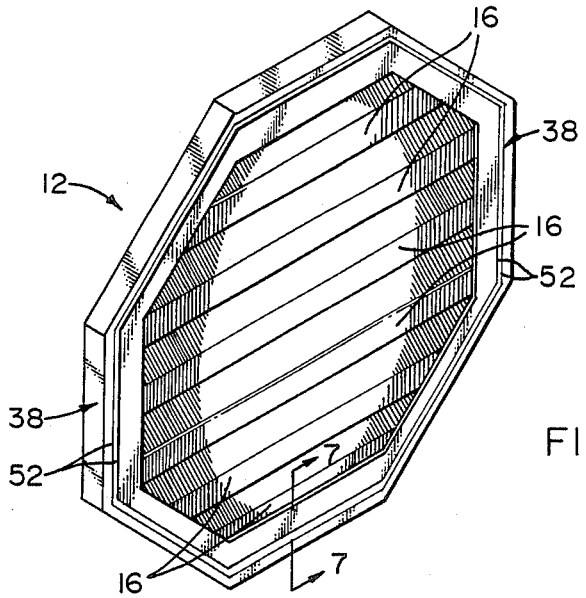
FIG. 1 is a pictorial view of an air vent or louver in accordance with the present invention.

Referring to the drawings, in particular to FIGS. 1–7, there is shown a particularly preferred embodiment of an air vent or louver in accordance with the present invention. The air vent or louver is shown generally by the reference number 12 and will be hereinafter referred to as louver 12. As illustrated, the louver 12 has the shape of a regular octagon whose included angles are all equal and whose sides are all equal in length. Although the louver 12 as shown as a preferred shape, it is to be expressly recognized that the shape can be varied such that the louver 12 can have any desired polygonal shape. Another preferred shape which is not illustrated is that of a rectangle.

Figure 2:
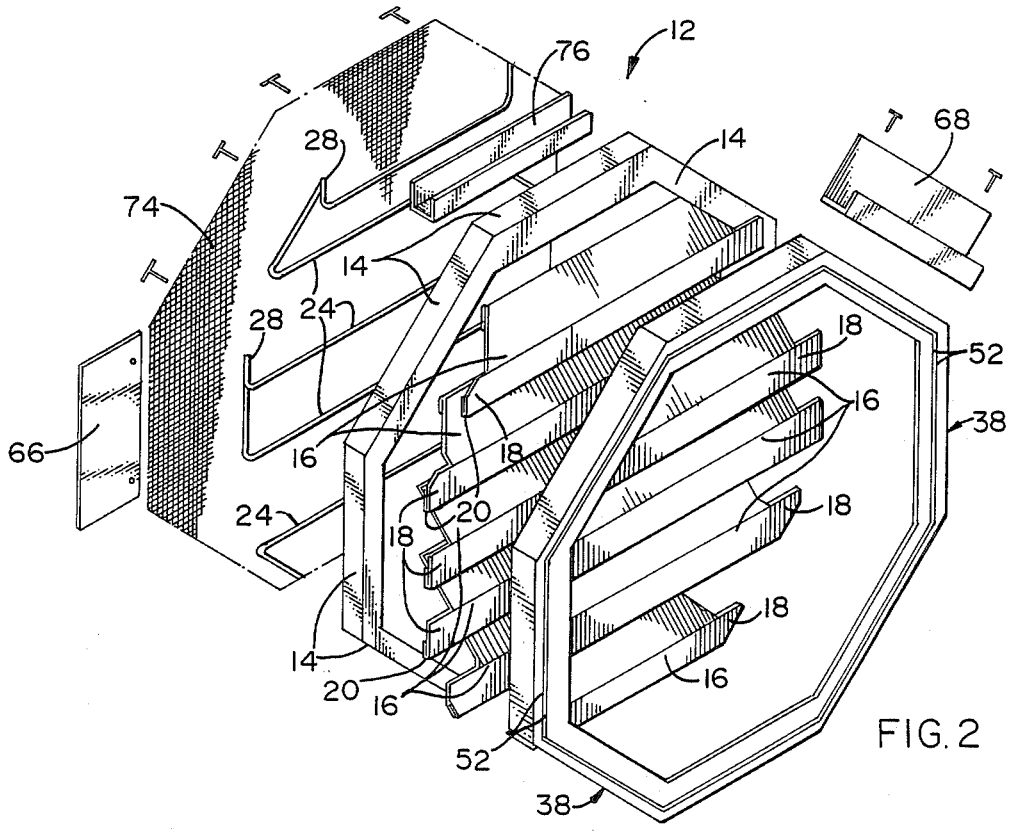
FIG. 2 is a blown up pictorial of the air vent or louver of FIG. 1.

The louver 12 in accordance with the invention comprises a wood frame consisting of a plurality of elongate wooden members 14. The wooden members 14 are attached together in end to end arrangement to form the enclosed polygonal frame as best illustrated in FIG. 2. The frame has a broad, flat, open front face which may be also referred to as the exterior or outer face thereof as well as the exterior or outer face of the louver 12 as a whole. The frame also has a broad, flat, open back face. For most sizes of louvers used in residential construction, the wooden members 14 are advantageously made from finished 1×2's which have a nominal cross-sectional dimension of ¾ inch by 1½ inch. For larger sized louvers 12, the wooden members 14 can be made of finished 2×2's which have a nominal cross-section of 1½ inches by 1½ inches. In all instances, it is preferable to orient the wooden pieces such that the broad side of the pieces form the radial perimeter of the frame.

The wood frame must be held secure and rigid to hold its shape. Preferably, the elongate wooden members 14 are mitered and securely attached to each other by mechanical fasteners such as nails or staples as well as by glue.

A plurality of spaced aluminum fins 16 extend from one side edge of the wood frame to the opposite side edge. The aluminum fins 16 are made to resemble wooden slats. To that end, each of the fins 16 is bent from a piece of aluminum sheet to have a substantially flat front portion lying substantially in the plane of the front face of the wood frame. Each fin 16 further has a substantially flat sloping portion which slopes from the front face of the wood frame to the back face of the wood frame.

Figure 9:
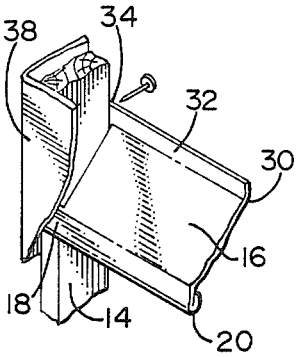
FIG. 9 is a view similar to that of FIG. 8 showing an alternative means of attaching the back corner of the fins to the wooden frame members and also showing a portion of the angle molding which covers the wood frame.
Figure 8:
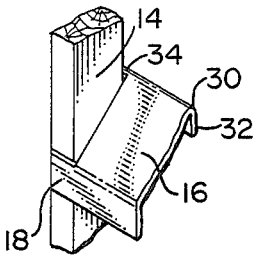
FIG. 8 is a fragmentary pictorial of a side member of the wood frame showing one means of attaching the corners of the fins to the wooden frame members.

Means are provided for securely anchoring the respective front corners of each of the fins to the edges of the wood frame at the front face thereof. As shown in FIGS. 2, 8 and 9, the means for anchoring the respective front corners of the fins 16 to the edges of the wood frame comprises tabs 18 formed at the front corners of the fins 16. The tabs 18 extend flatwise over the front side edge, and nails or stables can be drive through the tabs 18 to securely attach the front of the fins 16 to the front of the wood frame. The longitudinal free edges of the flat front portions of the fins 16 are preferably bent back upon themselves to form hem bends 20. The hem bends 20 make a finished edge for the fins 16 and adds strength and stability to the front edges of the fins 16.

Figure 7:
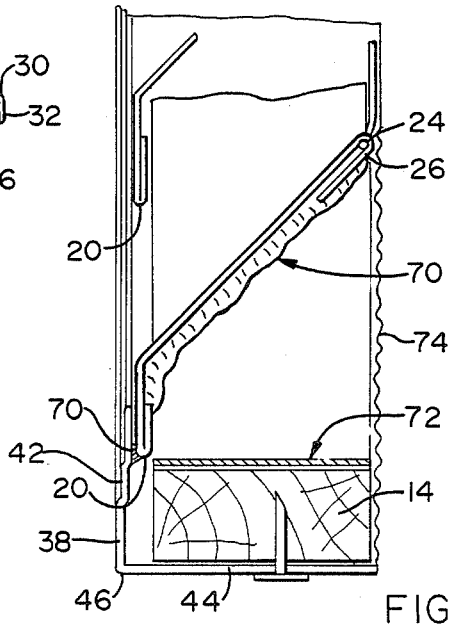
FIG. 7 is a cross-section of the lower portion of the air vent or louver as taxen along line 7—7 of FIG. 1.

Means are further provided for securely anchoring the respective back corners of each of the fins 16 to the back edges of the wood frame at the back face thereof. As shown in FIGS. 2 and 7, the anchoring of the back corners of the fins 16 can be accomplished in a unique novel application of a flexible wire or fishline. The fishline 24 extends through a hem bend 26 (FIG. 7) along the back edge of the fin 16. At each corner, the fishline 24 is pulled up in a loop 28 (FIG. 2) around a fastener such as a nail or staple. The fishline 24 then continues on to the next hem bend 26 in an adjacent fin 16. The fishline is thus threaded back and forth through the hem bends 26 in the fins 16 in a surpentine fashion. The fishline at each corner of the fins 16 is attached under a small tension to the side of the wood frame and thus anchors the corners of the fins 16 in place. An alternative means of anchoring the back corners of the fins 16 to the wood frame is shown in FIGS. 8 and 9. A longitudinal bend 30 extends across the fin 16 so as to bend the edge of the fin either upwardly as shown in FIG. 9 or downwardly as shown in FIG. 8. In either situation, the bent edge 32 of the fin extends substantially in the plane of the back face of the wood frame. Tabs 34 extend at the back corners of the fins from the bent edges 32 to the wood frame. The tabs 34 are attached to the edges of the wood frame by an appropriate fastener such as a nail or staple.

Figure 3:
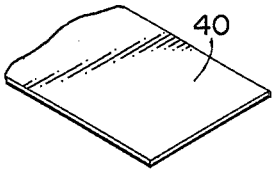
FIG. 3 is a fragmentary pictorial of a strip of sheet aluminum which is used to make the angle molding of the present invention.
Figure 4:
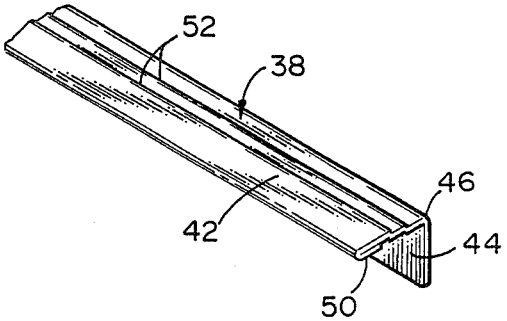
FIG. 4 is a fragmentary pictorial of the strip of sheet aluminum of FIG. 3 has been bent to form the angle molding of the present invention.

The outer face and radial perimeter of the wood frame is covered by a circuitous aluminum face molding 38. The face molding 38 finishes the perimeter of the louver 12 and is made such that the molding resembles wooden brick molding. The face molding 38 is made from an elongate sheet 40 of aluminum as is shown in FIG. 3. The sheet 40 is then bent along its longitudinal length to form an angle having first and second faces 42 and 44, respectively, extending from the longitudinal angle bend 46. The first and second faces 42 and 44 extend from the angle bend 46 in planes which are substantially normal to each other. The first face 42 preferably has its free, elongate edge bent back upon itself to form a hem bend 50. The hem bend 50 adds stability to the edge and finishes the edge of the molding 38. In addition, the first face 42 preferably has a pair of elongate bends 52 in the form of indentations formed therein. The elongate bends 52 extend parallel and are spaced from the angle bend 46. The elongate bends 52 gives the appearance to the first face of being made of wooden brick molding.

The first face 42 of the angle molding 38 has a plurality of cuts 65 made inwardly from the hem bend 50 on the longitudinal free edge of the first face 42. The cuts 54 are spaced along the first face 42 by a distance equal to the length of the polygonal sides 14 at the perimeter of the wood frame. The cuts 54 are made by establishing marking points along the angle bend 46 in the angle molding 38, with the marking points being spaced apart by a distance equal to the longitudinal length of the wooden members 14 as measured in the perimeter of the wood frame.

When making a louver which comprises a wood frame consisting of at least six elongate members 14 single cuts 54 can be cut inwardly in the first face 42 of the angle molding 38 from the hem bend 50 at the free side edge of the first face 42 toward a mutually respective marking point. This in effect forms separate sections in the first face 42 between the spaced cuts 54. The cuts 54 are made at an acute angle with the angle bend 46 of the angle molding 38, with the acute angle being equal to 360 degrees divided by the number of wooden members 14 in the wood frame.

Figure 5:
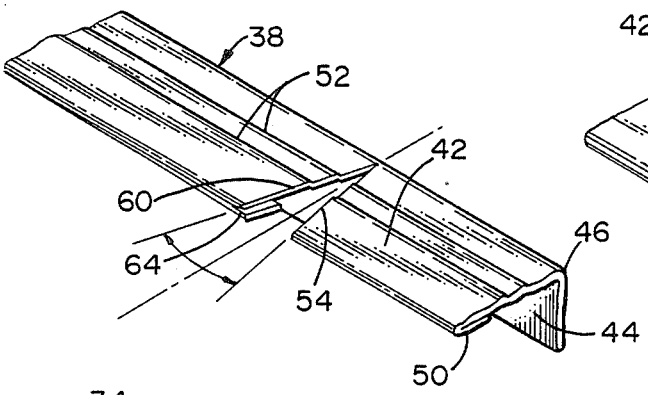
FIG. 5 is a fragmentary pictorial similar to that of FIG. 4 showing cuts in the first face of the angle molding and removal of a pie-shaped portion.

When making a louver which comprises a wood frame consisting of five or less elongate members 14, double cuts 54 and 60 must be made at each marking point along the angle bend 46. The first cut 54 in this case is made and aligned just as the cut mentioned in the previous paragraph. The second cut, shown by the reference number 60 in FIG. 5, is cut inwardly from the hem bend 50 toward a mutually respective marking point, with the second cut 60 being aligned so as to form an included angle of between about 20 degrees and 45 degrees with the mutually respective first cut 54. A pie-shaped piece is then removed between the cuts 54 and 60 as shown in FIG. 5. This in effect forms separate sections in the first face 42 between the spaced, pie-shaped spaces. The reason for the double cuts 54 and 60 and the removal of the pie-shaped pieces when making a louver comprising a wood frame consisting of five or less elongate members 14 will become apparent from the following discussions.

The angle molding 38 after being bent and cut as described above is bent and formed around the wood frame so that the second face 44 of the angle molding 38 lies flatwise against the perimeter of the wood frame to form a continuous enclosure around the perimeter of the wood frame. The separate sections of the first face 42 then extend inwardly in the open front face of the wood frame, with the marking points on the angle bend 46 being aligned around the perimeter of the wood frame with the junctures between the wooden members of the wood frame. The separate sections of the first face fold together to form a boxed molding around the perimeter of the front face of the wood frame.

Figure 6:
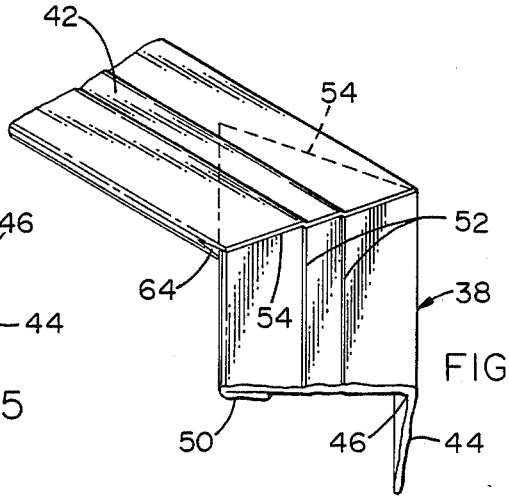
FIG. 6 is a fragmentary pictorial showing the angle molding bent about the inner ends of the cuts, with the cut ends of adjacent sections of the first face being interlocked together.

Means are provided for interlocking the portions of the first face 42 which are folded together, with the interlocking occurring at the folded intersections of the longitudinal free edge of the first face 42. In a preferred embodiment as illustrated in the drawings, the means for interlocking the portions of the first face 42 comprises a plurality of slits 64 (FIGS. 5 and 6) in the hem bend 50 on the free edge of the first face 42. At least one slit 64 extends from the intersection of the cuts 54 or 60 in the hem bend 50 such that when the portions of the first face 42 are folded together, the hem bend 50 in mutually respective portions of the first face 42 are received in sliding, interlocking engagement with the elongate slit 64 in an adjacent portion as is best shown in FIG. 6.

It can now be appreciated why in some instances only a single cut 54 need be made in the first face 42 and at other times a second cut 60 is needed with the removal of a pie-shaped piece between the cuts 54 and 60. When the louver 38 has six or more sides, the included angle between sides is large enough that only a single cut be made at each marking point on the angle molding 38. As shown in FIG. 6, the two adjacent edges of the cut 54 are interleaved, and because of the sufficient included angle between the sides of the louver 12, there is no interference with the leading edge (shown by dotted line in FIG. 6) with the second face 44 of the angle molding. However, for louvers 12 having five or less sides, the included angle between sides is small enough that the leading edge of the interleaved sections of the front face 42 would run into and interfere with the second face 44. Thus, in those instances, a pie-shaped piece is cut out between adjacent sections of the first face 42, so that when the sections are folded and interleaved at their respective adjacent ends there will be no interference with the second face 44.

The louvers 12 are designed to flush mount on the exterior wall of a building. To this end, means are provided on the inner face of the louver 12 or at least adjacent the inner face of the louver 12 for attaching the louver to a wall. Flat extension tabs 66 (FIG. 2) can be provided extending from the back face of the wood frame. The tabs 66 can then be used as nailing tabs to nail or staple the louver 12 flush against the wall to which it is to be attached. If the louver 12 is to be used on walls which are going to be covered with aluminum siding, it is advantageous to attach J-molding 68 (FIG. 2) to the perimeter of the wood frame such that the J-molding forms a means of attaching the louver 12 to the exterior wall and also forms a finished edge with aluminum siding applied to the exterior wall and which abuts the louver 12.

To divert rainwater away from the opening in the wall and the wall to which the louver 12 is attached, the fin 16 which is closest to the lower end of the louver is sealed along its side edges and bottom to the wooden frame and first face 42 of the angle molding 38. A bead of silicone sealant and adhesive is shown by the number 70 in FIG. 7. Other sealant materials could be used.

The interior side of the wood frame can be painted if desired or an elongate strip 72 of aluminum can be applied as shown in FIG. 7 if desired. A bug screen 74 is applied to the back side of the louver 12 to stop insects from entering the attic area through the louver 12.

A spacer member 76 can be provided at the upper end of the louver 12, such that the visible space between the spacer member 76 and the uppermost fin 16 appears to a person looking at the louver from the ground to be the same as the space between adjacent fins 16.

It is to be understood that the above-identified arrangements are only illustrative of the application of the principles of the present invention. Numerous modifications and alternative arrangements may be devised by those skilled in the art without departing from the spirit and scope of the present invention, and the appended claims are intended to cover such modifications and arrangements.

I claim:

1. An aluminum faced air vent or louver which is adapted to be flush mounted to an exterior wall of a building, said louver comprising a wood frame consisting of a plurality of elongate wooden members attached end to end to form an enclosed, polygonal frame having broad, flat open, front and back faces;

a plurality of spaced aluminum fins extending from one side edge of said wood frame to the opposite side edge thereof, each of said fins having a substantially flat front portion lying substantially in the plane of the front face of said wood frame, with each of said fins further having a substantially flat sloping portion which slopes from the front face of said wood frame to the back face thereof;

a circuitous aluminum face molding made from an elongate sheet of aluminum which has been bent along its longitudinal length to form an elongate angle having first and second faces, with the first face of the angle being cut inwardly from its longitudinal free edge to form spaced elongate cuts, said cuts being spaced by a distance equal to the length of the polygonal sides of said wood frame, said angle further being bent and formed around said wood frame such that the second face forms a continuous enclosure around the perimeter of the wood frame, with the first face being folded together at the cuts therein to form a boxed molding around the perimeter of the front face of said wood frame; and means for interlocking the portions of the first face which are folded together, said interlocking occurring at the folded intersections of the longitudinal free edge of said first face.

2. An aluminum faced air vent or louver in accordance with claim 1, wherein the elongate wooden members are mitered and securely attached to each other by a mechanical fastener as well as by glue to form a stable wood frame.

3. An aluminum faced air vent or louver in accordance with claim 1, wherein the means for interlocking the portions of the first face of said face moulding comprises a hem bend in the longitudinal free edge of said first face; and a plurality of elongate slits made in the hem bend on the free edge of said first face, with at least one slit extending from the intersection of each of said cuts in the hem bend of said first face, whereby when the portions of the first face are folded together, the hem bend in mutually respective portions of said first face are received in sliding, interlocking engagement with the elongate slit in an adjacent portion.

4. An aluminum faced air vent or louver in accordance with claim 1, wherein J-molding is attached to the perimeter of the wood frame such that the J-moulding forms a means of attaching the air vent or louver to the exterior wall and also forms a finished edge with aluminum siding which is applied to the exterior wall and which abuts the air vent or louver.

5. An aluminum faced air vent or louver in accordance with claim 1, wherein flat extension tabs are provided extending from the back face of the wood frame, such that the flat extension tabs form a means of attaching the air vent or louver to the exterior wall.

6. An aluminum faced air vent or louver in accordance with claim 1, wherein a pair of parallel bends are formed in the first face of said face molding such that the first face has the appearance of being made of wooden brick molding.

7. An aluminum faced air vent or louver in accordance with claim 1, wherein the fin which is closest to what is intended to be the lower end of the air vent or louver when attached to an outside wall is sealed along its side edges and bottom to the wooden frame and first face of said face molding respectively to direct rainwater to the outer face of said air vent or louver.

8. An aluminum faced air vent or louver in accordance with claim 1, wherein a spacer panel is provided at what is intended to be the upper end of the air vent or louver when attached to an outside wall such that the visible space between the spacer panel and the uppermost fin appears to be the same as the space between adjacent fins.

9. An aluminum faced air vent or louver in accordance with claim 1, wherein means are further provided for anchoring the respective front corners of said fins to the edges of said wood frame.

10. An aluminum faced air vent or louver in accordance with claim 9, wherein the means for anchoring the respective front corners of said fins to the edges of said wood frame comprises tabs formed at the front corners of said fins, with the tabs being securely attached to the edges of the wood frame.

11. An aluminum faced air vent or louver in accordance with claim 1, wherein means are further provided for anchoring the respective back corners of each of said fins to the edges of said wood frame.

12. An aluminum faced air vent or louver in accordance with claim 11, wherein the means for anchoring the respective back corners of each of said fins to the edges of said wood frame comprises a longitudinal hem bend formed in the aluminum fin at the back face of the wood frame, with a wire or line threaded through the hem bend and being attached at its opposite ends to the edges of said wood frame.

13. An aluminum faced air vent or louver in accordance with claim 11, wherein the means for anchoring the respective back corners of said fins to the edges of said wood frame comprises tabs formed at the back corners of said fins, with the tabs being securely attached to the edges of the wood frame.

14. An aluminum faced air vent or louver which is adapted to be flush mounted to an exterior wall of a building, said louver comprising a wood frame consisting of a plurality of elongate wooden members attached end to end to form an enclosed, polygonal frame having broad, flat, open, front and back faces;

a plurality of spaced aluminum fins extending from one side edge of said wood frame to the opposite side edge thereof, each of said fins having a substantially flat front portion lying substantially in the plane of the front face of said wood frame, with each of said fins further having a substantially flat sloping portion which slopes from the front face of said wood frame to the back face thereof;

a circuitous aluminum face molding made from an elongate sheet of aluminum which has been bent along its longitudinal length to form an elongate angle having first and second faces, with the first face of the angle being cut inwardly from its longitudinal free edge to form spaced elongate cuts, said cuts being spaced by a distance equal to the length of the polygonal sides of said wood frame, said angle further being bent and formed around said wood frame such that the second face forms a continuous enclosure around the perimeter of the wood frame, with the first face being folded together at the cuts therein to form a boxed molding around the perimeter of the front face of said wood frame; and means for interlocking the portions of the first face which are folded together, said means comprising hem bends formed in the longitudinal free edges of said first face, with a cut edge of the hem bend of one adjacent portion of the first face being received within the hem bend of a cut edge of the mututally respective portion of said first face such that interlocking occurs at the folded intersections of the longitudinal free edge of said first face.

* * * * *